United States Patent [19]

Sommer et al.

[11] Patent Number: 4,566,642

[45] Date of Patent: Jan. 28, 1986

[54] METHOD AND APPARATUS FOR MONITORING CHUCK OVERSPEED

[75] Inventors: Hans-Jörg Sommer, Zurich; Hansruedi Lamparter; Maurizio Wermelinger, both of Winterthur, all of Switzerland

[73] Assignee: Rieter Machine Works Ltd., Winterthur, Switzerland

[21] Appl. No.: 679,489

[22] Filed: Dec. 7, 1984

[51] Int. Cl.[4] ..... B65H 63/00

[52] U.S. Cl. ..... 242/18 R; 242/36

[58] Field of Search ..... 242/18 R, 36, 18 CS, 242/18 DD, 45, 49, 57

[56] References Cited

U.S. PATENT DOCUMENTS

| | | | |
|---|---|---|---|
| 4,307,848 | 12/1981 | Barathieu | 242/18 R |
| 4,394,986 | 7/1983 | Hasegawa et al. | 242/18 R |
| 4,458,849 | 7/1984 | Miyake et al. | 242/18 R |
| 4,494,702 | 1/1985 | Miyake et al. | 242/18 R |

FOREIGN PATENT DOCUMENTS

| | | | |
|---|---|---|---|
| 94483 | 11/1983 | European Pat. Off. | 242/18 R |

*Primary Examiner*—Stanley N. Gilreath

*Attorney, Agent, or Firm*—Werner W. Kleeman

[57] ABSTRACT

A winder is provided for winding synthetic filament into packages formed on a rotatable chuck which is directly driven by a drive motor. The speed of the drive motor, as represented by a suitable signal, is compared with a limit therefore, as represented by a second signal. The limit speed is reduced during formation of a package as an inverse function of the package diameter.

8 Claims, 17 Drawing Figures

Fig. 2
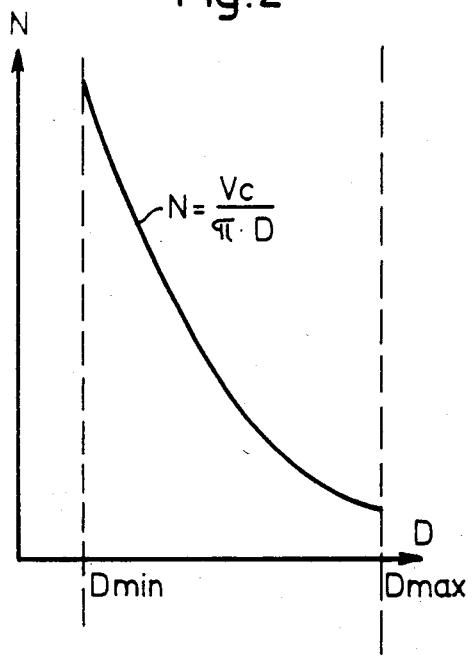
Fig. 3
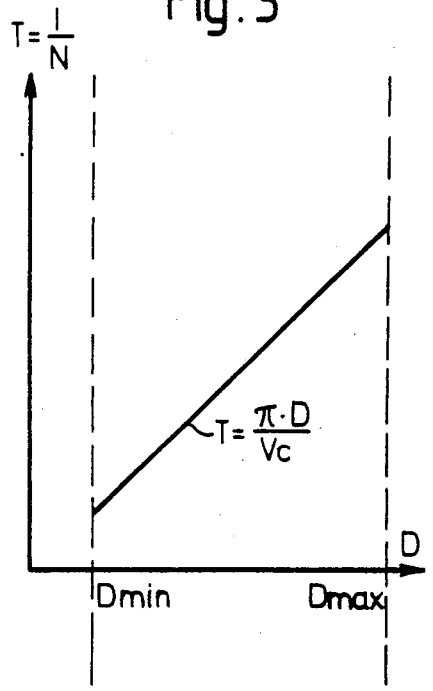
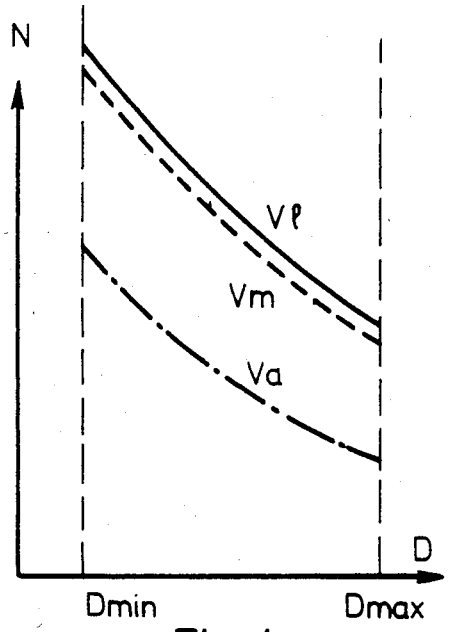
Fig. 4
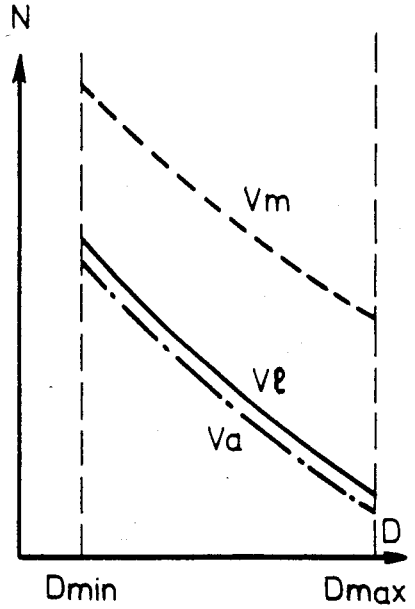
Fig. 5

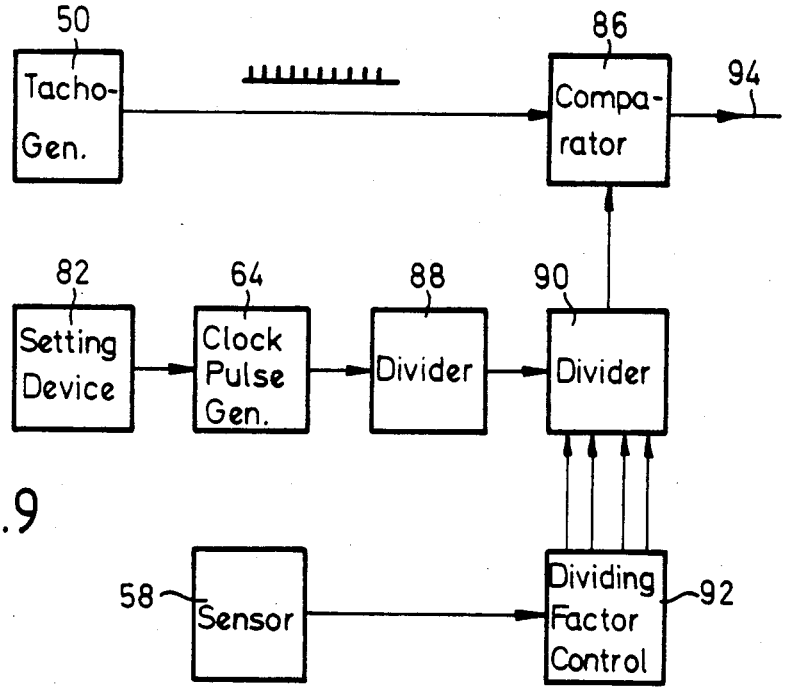
Fig.9
Fig. 10
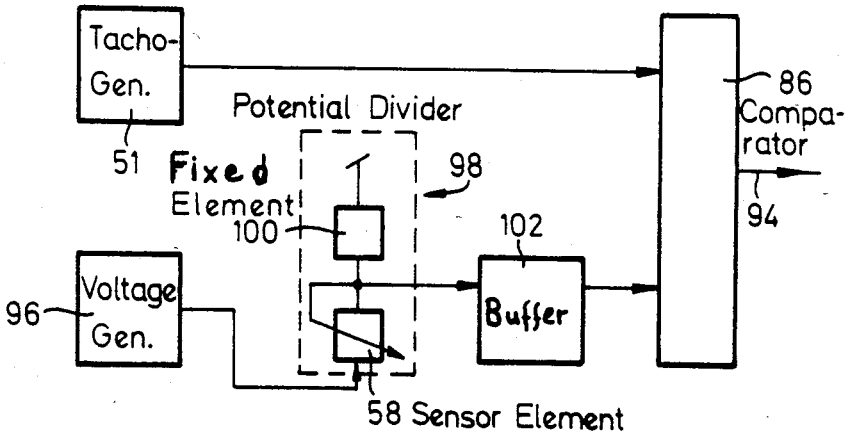

METHOD AND APPARATUS FOR MONITORING CHUCK OVERSPEED

BACKGROUND OF THE INVENTION

The present application broadly relates to winding of thread, particularly but not exclusively thread of synthetic filament. A thread of synthetic filament may be a mono filamentary or a multi-filamentary structure.

In its more specific aspects, the present invention concerns itself with a new and improved method for detecting an overspeed in winding of thread by a chuck-driven winder and also to a new and improved apparatus constituted by a winding machine comprising at least one chuck and means for driving the chuck into rotation about its own longitudinal axis.

PRIOR ART

A thread of synthetic filament is commonly wound into packages on a chuck of a filament winding machine. Each package is formed on a respective bobbin tube which is secured to the chuck during the winding operation so that the delivered thread is wound around the tube while being traversed axially of the tube in order to give a predetermined package build.

In the past, it has been a common practice to drive the chuck (and hence the package) into rotation about the longitudinal chuck axis by means of a driven friction drive roll in frictional engagement with the circumference of the package. With increasing winding speed, it becomes increasingly difficult to ensure reliable transfer of drive from the friction drive roll to the package/-chuck combination. It is therefore becoming increasingly common to drive the chuck (sometimes referred to as the "spindle") directly.

An advantageous system for enabling this is described and claimed in the U.S. patent application Ser. No. 379134 filed May 17, 1982 and entitled CHUCK DRIVE SYSTEM. However, the present invention is not limited to use in conjunction with the system described in that prior United States Patent Application which corresponds with European Published Patent Application No. 94483.

The control system required for a chuck driven winder is more complex than that needed for a friction driven winder. This is because the thread is delivered at a substantially constant linear speed throughout the winding operation and must be taken up at that speed at the circumference of the package; since the package diameter increases from a value equal to the external diameter of the empty bobbin at the start of the winding operation to a predetermined maximum at the end of the winding operation, the rotational speed of the chuck must be correspondingly reduced throughout the winding operation. The increased complexity in the control system entails an associated increased risk of faults in operation. One particularly dangerous fault in a chuck driven winder is "overspeed" of the chuck drive motor.

European Published Patent Application No. 83731, published July 20, 1983, describes a system for monitoring a chuck driven winder during a winding operation and reacting to a sensed overspeed of the chuck drive. The solution put forward in that published application is proposed as an alternative to "a method wherein upper limit values slightly higher than the predetermined rotational speed changing pattern are previously programmed in accordance with the change of the rotational speed of the spindle while it is winding a yarn."

This method is rejected in the published application because "programming of the winding pattern is necessary whenever the winding conditions, such as thickness in yarn, winding speed, tension in yarn are changed."

As an alternative to this rejected method, the aforementioned European Patent Application No. 83731 proposes that an overspeed monitor should ensure that the speed at any sampling instant during the winding operation does not exceed the speed at the preceding sampling instant by more than a predetermined amount. The monitor described in such European Application No. 83731 is therefore designed to react to a rising rotational speed of the spindle or chuck.

The solution put forward in the aforementioned European Patent Application No. 83731 appears to overlook two facts, namely (a) for the purpose of monitoring overspeed of the chuck, the various "programming" parameters such as yarn thickness, winding speed, yarn tension etc. can all be subsumed under the parameter "package diameter"; and (b) reaction to a rising chuck rotational speed is insufficient protection for a reason given in the immediately following paragraph.

The overspeed monitor of a chuck driven winder is concerned more directly with safety than with process control. It is not a primary function of the overspeed monitor to ensure that the thread be taken up at a desired speed. It is, however, important to recognize that the maximum, safe rotational speed of the chuck will decline as the package diameter increases. In order to obtain efficient utilization of the winding machine, the chuck is normally loaded at levels approaching a safe operating limit. It is increasingly common now to provide relatively long chucks enabling formation of very large packages or of a plurality of thread packages simultaneously on the one chuck. A maximum rotational speed which is permissible when the chuck is carrying only empty bobbin tubes can be well above the safety limit for a chuck carrying a full package or packages. Thus, a chuck rotational speed which is correct at some specific stage of a winding operation but, incorrectly, is maintained constant after that stage can eventually become unsafe with increasing package diameter, but would not be detected by a system as proposed in such European Patent Application No. 83731.

SUMMARY OF THE INVENTION

Therefore, with the foregoing in mind, it is a primary object of the present invention to provide a new and improved method and apparatus for monitoring chuck overspeed which do not exhibit the aforementioned drawbacks and shortcomings of the prior art constructions.

Another and more specific object of the present invention aims at providing a new and improved method and apparatus of the previously-mentioned type which prevent the arisal of unsafe chuck rotational speeds during all phases of operation.

Yet a further significant object of the present invention aims at providing a new and improved apparatus for monitoring chuck overspeed of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the features that it provides a method of detecting rotational overspeed of the chuck of a chuck-driven thread winder comprising the steps of producing a first signal representative of the chuck rotational speed and a second signal which is a function of package diameter. The first and second signals are compared. A reaction is produced when the comparison indicates that the chuck rotational speed exceeds a variable limit represented by the second signal.

The apparatus of the present invention for detecting rotational overspeed of the chuck of a chuck-driven thread winder is manifested by the features that it comprises means for producing a first signal representative of chuck rotational speed, means for producing a second signal which is a function of package diameter and means for comparing the first and second signals so as to provide a predetermined output signal when the comparison indicates that the instantaneous chuck rotational speed exceeds a variable limit represented by the second signal.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIGS. 2 through 5 show respective diagrams for use in identification of the concepts underlying the present invention, FIG. 9 is a circuit diagram of a chuck overspeed monitor in accordance with a fourth embodiment of the invention, FIG. 10 is a circuit diagram of an embodiment which is similar to that shown in FIG. 9 but which is adapted to operate on analog instead of digital signals, FIGS. 12(*a*) and 12(*b*) show alternative more detailed arrangements which can be used in the embodiment of FIG. 12.

DETAILED DESCRIPTION OF THE PREFERRED EMBODIMENTS

Chuck-driven Winders

Describing now the drawings, it is to be understood that to simplify the showing thereof only enough of the structure of the winding machine has been illustrated therein as is needed to enable one skilled in the art to readily understand the underlying principles and concepts of this invention.

Figure 1:
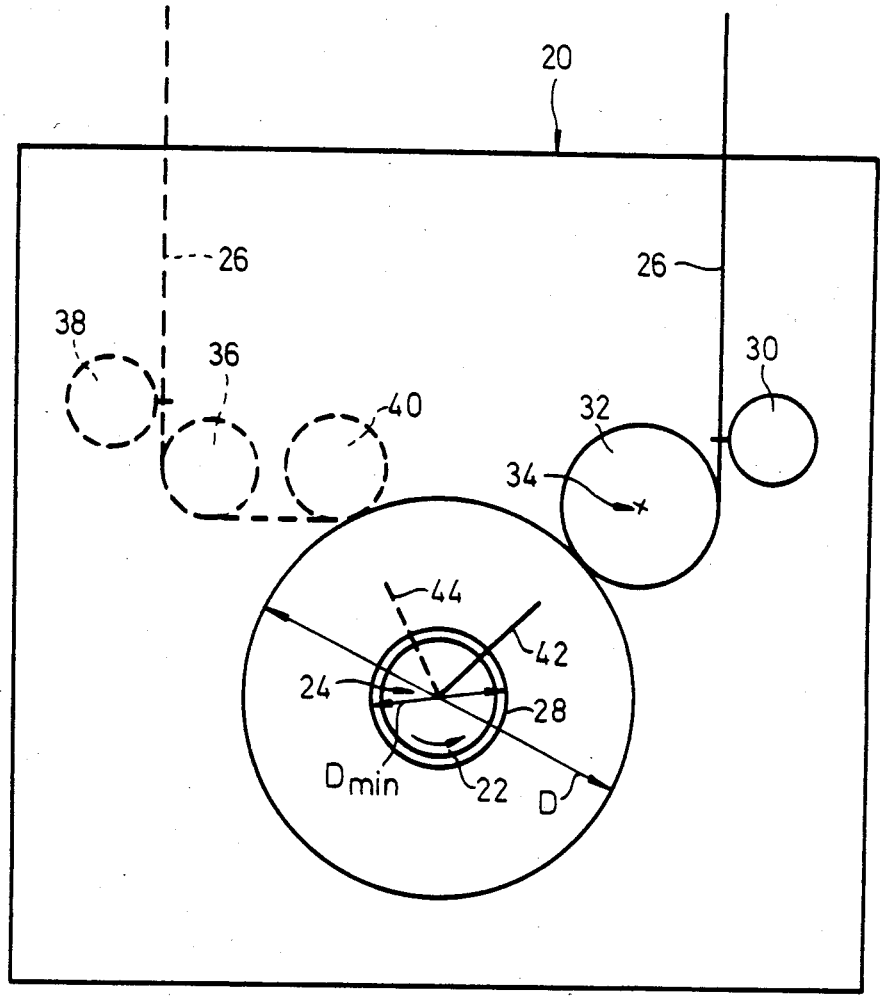
FIG. 1 is a diagrammatic representation of a filament winder of a type relevant to the present invention.

Turning now specifically to FIG. 1 of the drawings, there will be seen illustrated therein by way of example and not limitation a plurality of different winder systems in which the present invention can be applied. Reference will be made first to the portion of the drawing depicted in full lines.

The diagram shows a chuck-driven winder 18 in front elevation. Reference numeral 20 indicates a headstock containing drive and mounting elements which will not be described in detail in this specification since they can be of conventional construction. Reference numeral 22 indicates a chuck (or spindle) which projects forwardly, cantilever-fashion from head stock 20. Chuck 22 is mounted within head stock 20 to enable rotation of the chuck about its longitudinal axis 24. The winder is of the type in which a conventional and therefore not particularly shown suitable drive motor in headstock 20 is directly coupled to chuck 22 to produce rotation in the direction of the arrow A shown on the chuck 22.

For simplicity of description and illustration, winding of only one thread 26 will be referred to herein. As is well-known, however, a plurality of threads can be wound simultaneously into a corresponding plurality of packages of a single chuck and it will be clear that the principles of the present invention are equally applicable to such systems.

The thread package is formed on a bobbin tube 28 which is releasably attached to chuck 22 during the winding operation for rotation therewith about the axis 24. In order to obtain a desired package build, thread 26 is traversed to and fro axially of bobbin tube 28 by means of a conventional traverse mechanism 30.

The winder structure illustrated in full lines in FIG. 1 is of the so called print-friction type in which the thread 26, after leaving the traverse device 30, passes around a part of the circumference of a roller 32 before being transferred to the package building on the bobbin tube 28. In the illustrated system, roller 32 is assumed to be mounted within headstock 20 in a manner permitting it to rotate about its longitudinal axis 34 and this axis is assumed to be parallel to the chuck axis 24 and fixed relative to the headstock 20. At the start of a winding operation (that is, the winding of one package), roller 32 is in contact with the empty bobbin tube on chuck 22. Roller 32 maintains contact with the periphery of the package building on bobbin tube 28 until the completion of that winding operation (that is, the completion of winding of that same package). Accordingly, under the assumed circumstances, the mounting of the chuck 22 is such that the chuck 22 can move relative to the roller 32 in order to permit build-up of the package between the chuck 22 and the print-friction roller 32.

The chuck 22 is pressed towards roller 32 throughout the winding operation so that roller 32 is constrained to rotate with a circumferential (or "tangential") speed equal to the instantaneous circumferential speed of the package. A not particularly shown, conventional tachogenerator is coupled to the roller 32 and provides a feedback signal enabling control of the drive to the chuck 22 in order to maintain the circumferential speeds of both the package and the roller substantially constant and equal to the linear speed at which thread 26 is delivered to the winder 18. As indicated above, this requires a constant reduction of the rotational speed of the chuck 22 as the package builds up between the chuck 22 and the roller 32.

It will be clear that build-up of the package between the chuck 22 and roller 32 could equally well be accommodated by having the roller 32 and traverse mechanism 30 movable relative to a chuck 22 rotatable about an axis 24 fixed in the headstock 20. Alternatively, both chuck 24 and roller 32 (with traverse mechanism 30) could be movable relative to headstock 20 in order to accomodate the package build-up.

The dotted lines in FIG. 1 illustrate an alternative system to the above-mentioned print-friction "type" with the roller 32. In this alternative system, an additional grooved roller 36 is provided in the thread path between the traverse mechanism 38 and a contact roller 40 which engages the circumference of the package in the region in which the thread 26 makes contact with the package. There is at the most a relatively small angle of wrap of the thread around the contact roller 40 when compared with the printfriction roller 32. This system is well-known in the filament winding art and by way of example details of one variant thereon can be found from U.S. Pat. No. 4,274,604 granted June 23, 1981.

As in the case of the print-friction system, in the "grooved roller" system either the chuck 22 can be movable in order to allow package build-up or the contact roller 40 (together with grooved roller 36 and traverse mechanism 38) can be movable to allow package build-up, or such build-up can be permitted by a combination of such movements.

Finally, FIG. 1 illustrates only a single chuck 22 so that at the completion of a given winding operation it is necessary to breakoff winding while the package or packages are removed from chuck 22 and replaced by a fresh bobbin tube 28 or fresh bobbin tubes. During this operation, the thread 26 must be passed to waste. As is well-known, it is possible to provide the winding machine 18 with a plurality of chucks so that when a winding operation on one chuck is completed another chuck can be moved automatically into a winding position and thread transfer can be effected so as to permit substantially continuous, wasteless winding of thread. Such automatic changeover systems are well-known. Each individual winding operation (package formation) uses the same principles as winding of a package on a single chuck, and accordingly the present invention is clearly applicable also to these automatic changeover machines.

Underlying concepts

In each of the four diagrams in FIGS. 2–5 inclusive the package diameter D is represented on the horizontal axis, and is assumed to vary from a minimum diameter (D min) to a maximum diameter (D max). The minimum package diameter is represented in practice by the external diameter of the bobbin tube (28 in FIG. 1) and the maximum diameter is determined by the overall machine design.

In FIG. 2, the rate N of rotation of the chuck 22 (in revolutions per unit time) is represented on the vertical axis, and the curve shows that this rotational rate must decline as a hyperbolic function for a constant circumferential speed Vc of the package. In FIG. 3, the time T required for a single revolution is shown on the vertical axis for the same constant circumferential speed Vc. As shown, the time required increases as a linear function of the package diameter D.

In each of FIGS. 4 and 5, the rotational rate N of the chuck 22 is shown on the vertical axis. For given machine design there will be a maximum designed circumferential take-up speed Vm. However, for a given winding operation the winder 18 may be used at a speed below its maximum designed rating, for example at an "actual" take-up speed Va. The figures then illustrate two basically different monitoring principles; in FIG. 4, a limit take-up speed Vl is defined at a predetermined level above the maximum take-up speed Vm. In FIG. 5, the limit take-up speed Vl is defined at a predetermined level above the actual take-up speed Va, which as indicated above may or may not be equal to Vm in any given winding operation.

Either of these monitoring principles can be used in accordance with the present invention. It is important to note that in both cases the permissible maximum rotation rate Nl of the chuck 22 will decline as an inverse function of the package diameter D. As can be seen from FIG. 4, at any selected package diameter D the system represented by such FIG. 4 permits a relatively large overspeed (the difference between the rotation rates corresponding to Vl and Va respectively) of the chuck except when Va is equal to Vm. The practical circumstances of use will determine whether such operation is acceptable or not.

In the case of the system shown in FIG. 4 the limit speed Vl represents a maximum possible operating speed for the winder 18 under all circumstances. In the system shown in FIG. 5, however, there is no corresponding absolute limit, since the limit takeup speed is related to the set take-up speed Va and if the winder drive motor is mechanically capable of driving the winder 18 at a speed substantially higher than the designed maximum operating speed Vm, then there is still a possibility of unsafe operation due to setting or control error. In such circumstances, an additional monitor to limit the maximum settable speed will also be desirable.

Despite the additional complexity associated with the system of FIG. 5, in comparison to the system of FIG. 4, this system forms the basis of the preferred embodiments of the present invention. Embodiments in accordance with FIG. 4 will, however, also be described. It is, however, an essential feature of all of the embodiments to be described that a means is provided for generating an output signal representing the build-up of the package from its minimum value D min to its maximum value D max. Referring especially to FIG. 1 this means could take a large number of possible forms depending upon the winder structure selected.

Assuming, for example a print-friction type system with the chuck 22 movable relative to a "fixed" print-friction roll 32, the axis 24 of the chuck 22 might be movable along a curved path indicated at 42 in FIG. 1. Sensor means of conventional type and therefore not particularly shown could be provided to respond to the position of the chuck axis 24 along this path 42. A similiar path 44 (depicted in dotted lines) might be definable in a "grooved roller" type system with a movable chuck 22, and a similar sensor could be provided in such a case.

Clearly, exactly analogous arrangements can be made where the chuck axis 24 is maintained stationary relative to the headstock 20 and a print-friction roll 32, or the contact roll 40, is moved to permit package build-up. Curved paths 42, 44 have been shown by way of example only in FIG. 1 and correspond to mounting of a movable chuck on a swing arm as a carrier structure. It would be simpler to mount a movable friction-roll 32 or contact roll 40 on a carriage linearly reciprocable relative to headstock 20. A linearly reciprocable carriage could also be used to carry a movable chuck 22.

A more complex sensor, responsive to the spacing of the chuck axis 24 from the axis 34 of the roller 32 or from the corresponding axis of the contact roller 40 would be needed in a system in which both the chuck 22 and roller 32 or 40 are movable relative to the headstock.

In the above described systems, the signal representing package build-up is produced by response to positioning of one part of the machine (for example the chuck 22) relative to one or more other parts (for example the headstock 20 or the roller 32 or 40). However, a sensor could be provided to respond directly to the build-up of the package itself, for example, as shown in U.S. Pat. No. 3,671,824 granted June 20, 1972. However, such systems will usually be complex and difficult to incorporate in a practical machine construction. It will generally be preferable to respond to relative movement of machine parts associated with the package build operation.

The signal representative of package build-up does not have to be continuously variable as the package diameter D increases but can be varied in a series of steps. The number of steps will depend upon the permissible tolerances with regard to overspeed.

It is also an essential feature of all embodiments of the invention that a signal (referred to hereinafter as a "tachosignal") is produced which varies as a function of the rotational rate N of the chuck 22. For example, a tacho-generator may be associated with the chuck 22 so that a part of the tacho-generator rotates with the chuck 22 and causes the tacho-generator to produce an output signal ("tachosignal") representative of the rotational rate of the part. This tachosignal may be in pulse form or in analog form. However, the tacho-generator may be unnecessary if the chuck is driven by an AC drive motor and the frequency of the energy supply to the motor can be taken as representative of the motor speed. This is the case if a synchronous drive motor is used. It is also the case if an asynchronous drive motor is used if the motor slip is either constant over the required operating range or is so small that it can be neglected. The tachosignal can then be derived directly from the motor supply.

EMBODIMENTS

Figure 6:
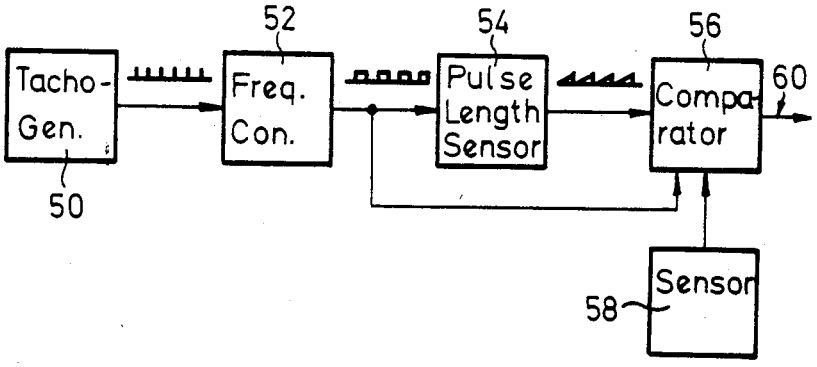
FIG. 6 is a circuit diagram of a chuck overspeed monitor in accordance with the invention, FIGS. 6A through 6C each show a respective signal waveform which could be produced in this first embodiment of the invention.
Figure 6:
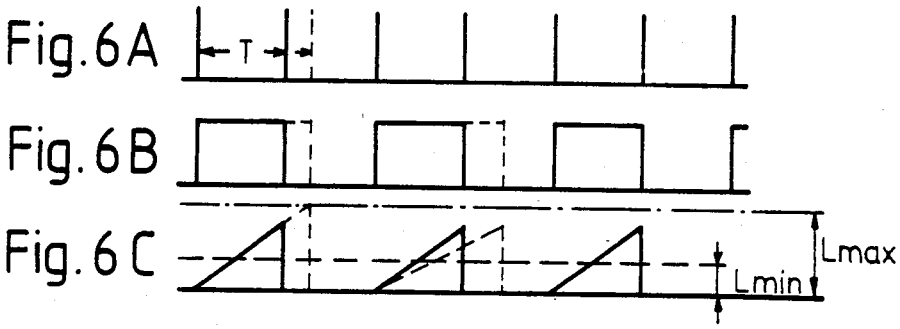

In the block circuit diagram of FIG. 6 a tacho-generator responding to the chuck rotational rate N is indicated by the reference numeral 50. The tacho-generator 50 is assumed to be producing a pulse output signal (tachosignal) shown in FIG. 6A. Assume that a predetermined number of pulses is produced at the tacho-generator output for each revolution of the chuck 22.

For convenience of illustration it has been assumed in FIG. 6A that one pulse is produced by the tacho-generator 50 per revolution of the chuck 22. Thus, the interval between successive pulses can be represented as T and corresponds to the time for one revolution shown on the vertical axis in FIG. 3. However, this is by no means essential - a higher pulse rate per revolution could be used in the tachosignal and may be desirable in some circumstances, especially where greater accuracy is required. The tachosignal is provided as an input to a frequency convertor 52, the output of which is a series of rectangular pulses shown in FIG. 6B. Frequency convertor 52 can be a device the output of which is switchable between high and low states respectively, the device reversing its instantaneous output state in response to each tachosignal pulse.

The output of frequency convertor 52 is fed to a pulse-length sensing device 54 which is responsive to the length of each rectangular pulse supplied by the frequency convertor 52. In FIG. 6 this pulse length sensor 54 is assumed to be a saw-tooth generator comprising a capacitor which is charged continuously at a predetermined uniform rate when the input to the pulse-length sensor 54 is high, and which discharges rapidly as soon as the input to this pulse-length sensor 54 goes low. The resultant saw-tooth waveform at the output of the pulse-length sensor 54 is shown in FIG. 6C.

From FIG. 3 it will be apparent that the interval T between successive pulses in the tachosignal (FIG. 6A) must increase continuously as the package diameter D increases. This has been represented for the first two pulses only in FIG. 6A by shifting of the second pulse to the right (dotted line position) relative to the first pulse. Correspondingly, the length of each rectangular pulse at the output from frequency convertor 52 will be increased to correspond to the lengthening interval T between the pulses of the tachosignal; this has been represented by the dotted line extension of the first rectangular pulse shown in FIG. 6B. Assuming a constant charging rate for the capacitor in the pulse length sensor 54, the capacitor will be charged to a higher voltage by the longer rectangular pulses as also indicated in dotted lines for the first saw-tooth in FIG. 6C.

The saw-tooth output of the pulse length sensor 54 is passed as an input to a comparator 56. This comparator also receives the rectangular pulses from frequency convertor 52 (FIG. 6B) so that it works in accordance with an operating cycle corresponding to the cycle of the output signal (FIG. 6B) of the frequency convertor 52, that is with a varying cycle period corresponding to twice the length of the rectangular pulses in FIG. 6B. During each cycle, comparator 56 compares the voltage of the input signal it receives from the pulse length sensor 54 with a threshold level determined by a sensing device 58 as described immediately below.

Sensor 58 is the sensor described above which is responsive to the build-up of the package. Sensor 58 is assumed in this case to produce as an output signal a DC potential L which rises as a linear function of package diameter D from a minimum value L min (corresponding to D min) to a maximum value L max (corresponding to D max). The instantaneous value of this DC potential L represents the instantaneous threshold level for the comparator 56, and minimum and maximum threshold levels have been shown by way of example in FIG. 6C. The two sensor devices 54 and 58 are so arranged in relation to each other that, for a normal package build, the peak voltage achieved in each saw-tooth in FIG. 6C exceeds the corresponding threshold level L by a predetermined potential difference. If, at any given package diameter D, the chuck 22 is travelling with an overspeed, then the interval T between pulses in the tachosignal (6A) and the corresponding length of each rectangular pulse (6B) will be short relative to the designed values, and the peak voltage reached by the capacitor in the pulse length sensor 54 will fall below the designed level. When the overspeed is excessive, the peak of a saw-tooth in FIG. 6C will fall below the corresponding threshold, and comparator 56 will produce an alarm signal on its output 60. The alarm signal can be used to stop the winder 18 and/or to provide an audible or visual alarm. Expressed more briefly, within the period for which the output signal (FIG. 6B) from the frequency convertor 52 is high, the output signal from the pulse length sensor 54 must exceed the threshold defined by sensor 58, otherwise an alarm is produced.

The embodiment described above with reference to FIG. 6 corresponds to a system in accordance with FIG. 4 in that the threshold L is dependent only upon package diameter D, and no other steps are taken to make the system responsive to variation in the set take-up speed. The embodiment could, however, be modified to represent a system as shown in FIG. 5 by providing means in the pulse length sensor 54 to vary the charging rate of the capacitor in dependence upon the set take-up speed. This is indicated by the dotted line on the second saw-tooth in FIG. 6C. If the capacitor in the pulse length sensor 54 charges more slowly in response to each rectangular pulse received from frequency convertor 52, then any given threshold level L represents a longer rectangular pulse in the output from the frequency convertor 52. If, however, this threshold level L is associated with the same package diameter D regardless of the charging rate of the capacitor, then the longer rectangular pulse length in the frequency convertor output must be associated with a slower set speed for the take-up (see FIG. 3).

Variation in the rate of charging of the capacitor in the pulse length sensor 54 can be effected by adjusting the capacitor charging circuit in a substantially known manner. The charging circuit adjusting means can be linked automatically to the take-up speed setting device in the main machine control. The capacitor charging circuit may be continuously adjustable as the set take-up speed is adjusted, or may be adjusted in a series of steps in accordance with pre-defined ranges of set take-up speed. In the latter case, there may be a plurality of capacitor charging circuits corresponding to the number of pre-defined set speed ranges, and the pulse length sensor 54 may be switched from one charging circuit to the other in response to selection of a set take-up speed for a given winding operation.

In the above example, the frequency convertor 52 has been so arranged that its output frequency is half the pulse frequency of the tachosignal (FIG. 6A). This is not essential. Any other desired frequency division rate could be chosen. In particular, if the pulse frequency of the tachosignal is found to be variable because of minor (but acceptable) speed variations, then a higher division ratio in the frequency convertor could be useful in order to average out some of these variations. Also, if timing problems arise in the response of the circuitry following the frequency convertor, then a larger division ratio could be useful.

Figure 7:
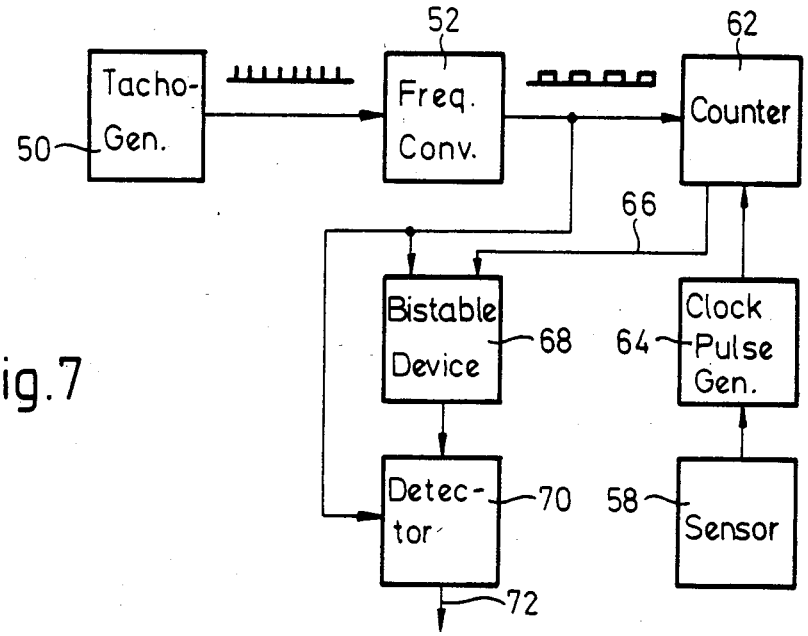
FIG. 7 is a circuit diagram of a chuck overspeed monitor in accordance with a second embodiment of the invention.

The embodiment of FIG. 7 operates on a similar principle to that described above of FIG. 6, and as far as possible similar reference numerals have been generally used for similar parts. Thus, there is again a tachogenerator 50 producing a pulse output in the form shown in FIG. 6A. There is also a frequency convertor 52 producing a rectangular pulse output in the form of FIG. 6B. Furthermore, there is a sensor 58 producing an output signal which varies as a function of the build-up of the package diameter.

In this case, however, the rectangular pulses from frequency convertor 52 are fed to a counter 62 which also receives pulses from a clock or clock pulse generator 64. Counter 62 is arranged to start counting the clock pulses as soon as it senses the leading edge of a rectangular pulse from the pulse length sensor 52 and to stop counting clock pulses as soon as it senses the trailing edge of the same rectangular pulse. Counter 62 is of the so-called "overflow" type in which an output signal is provided on an output 66 when the instantaneous count exceeds some predetermined value. Details of such overflow counters can be found for example in the book HALBLEITER-SCHALTUNGSTECHNIK (Fifth Edition) by U. Tietze and Ch. Schenk published by Springer Verlag in Chapter 20.1.2 at Page 496.

The clock or clock pulse generator 64 is arranged to produce a controllably variable output pulse rate, which can be controlled by an input received by the clock from the sensor 58. Sensor 58 and clock 64 are so arranged that the clock pulse output rate is an inverse function of the package diameter D. Accordingly, the constant "overflow" value set into counter 62 corresponds to steadily lengthening rectangular pulses from the frequency convertor 52 as the package diameter D increases during a given winding operation causing a corresponding reduction in the clock pulse rate from clock 64.

Output 66 from counter 62 is passed to a bistable device 68, for example a multi-vibrator or "flip-flop". Bistable device 68 also receives the rectangular pulse output from frequency convertor 52. Bistable device 68 is set in one condition by the leading edge of a rectangular pulse from frequency convertor 52, and can be reset in its original condition by "overflow" input from counter 62. The output of bistable device 68 is passed to "overspeed detector" 70 which also receives as an input the rectangular pulses from frequency convertor 52. If, after the leading edge of a given rectangular pulse from frequency convertor 52 has started a count sequence in counter 62 and has set bistable device 68, the latter has not been reset by an "overflow" signal on the output 66 before the output of frequency convertor 52 goes low at the trailing edge of the same rectangular pulse, then detector 70 will issue an "overspeed detected" signal on its output 72. Detector 70 may, however, be arranged to issue this fault or alarm signal only after a predetermined delay, so that if the operation returns to normal within a predetermined number of cycles, no fault signal will be issued.

The embodiment illustrated in FIG. 7 operates in accordance with the principle shown in FIG. 4. That is, the limit take-up speed decreases with increasing package diameter D because of the correspondingly declining clock rate of clock 64), but is unrelated to the set take-up speed (because the "overflow count" in counter 62 is set as a predetermined value). Commercially available overflow counters do not generally have an adjustably variable overflow value, so that the embodiment shown in FIG. 7 cannot be readily modified for operation in accordance with FIG. 5. This can be achieved, however, by means of the substantial modification illustrated in FIG. 8.

Figure 8:
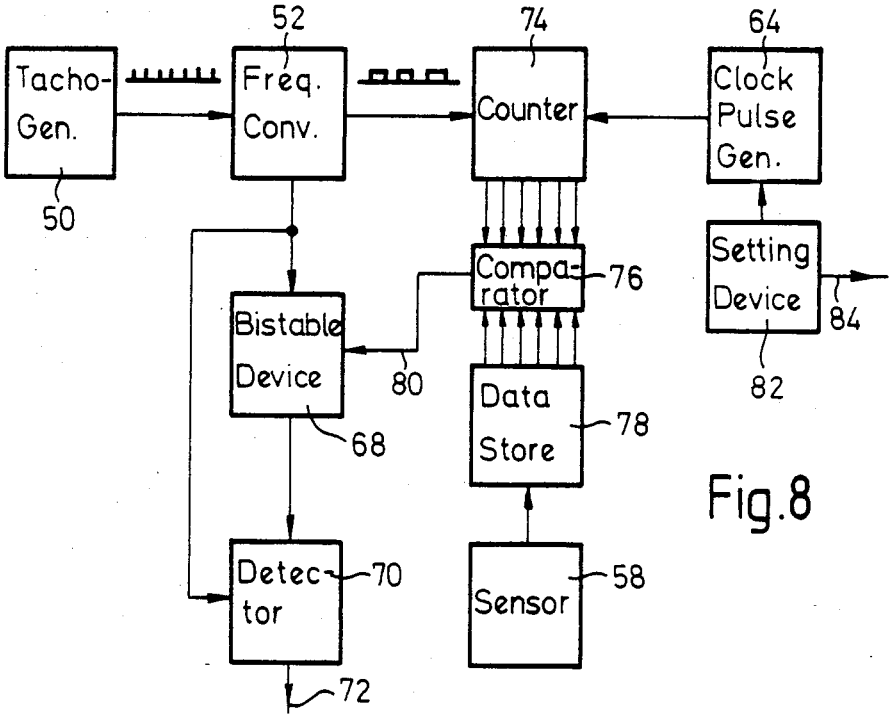
FIG. 8 is a circuit diagram of a chuck overspeed monitor in accordance with a third embodiment of the invention.

In FIG. 8, parts which are identical to parts described with reference to FIG. 7 have generally been indicated with the same reference numerals and will not be individually described again. The counter which counts clock pulses issued from clock pulse generator 64 is now indicated by the reference numeral 74. This counter is not of the overflow type but is designed instead to supply its instantaneous count as an output to a comparator 76. The comparator 76 compares the instantaneous output of counter 74 with a controllably variable threshold level provided by a data storage device 78. The threshold signal output provided by data storage device 78 is controllably adjustable during a given winding operation in response to the instantaneous output of the sensor 58 previously described above. The threshold level set by data storage device 78 increases as a linear function of the package diameter D during the winding operation.

When comparator 76 detects that the output of counter 74 is equal to or greater than the threshold level set by data storage device 78, it provides a reset signal on output 80 to reset the bistable device 68 which operates in the manner already described with reference to FIG. 7. Accordingly, as the package diameter D increases, counter 74 must be enabled by steadily longer rectangular pulses from counter 52 in order to avoid the production of an "overspeed detected" signal at output 72, that is the limit take-up speed declines with increasing package diameter D.

In order to make the arrangement responsive to the set take-up speed, the controllably adjustable clock pulse generator 64 is made responsive to a setting device 82 by means of which the desired take-up speed can also be set in the main winder control by way of the additional output 84. A suitable form of setting device will be described later. For the present it is sufficient to indicate that the clock pulse rate is a linear function of the set take-up speed. Thus, any given threshold level determined by data storage device 78 represents a controllably adjustable limit take-up speed Vl depending upon the clock rate set by setting device 82.

Setting device 82 itself will clearly depend to some extent upon the type of drive used for the chuck 22. The preferred drive is an asynchronous electrical motor which can be controlled by adjusting the frequency of the electrical supply producing the energizing field in the motor. As is now well-known in the filament winding art, adjustment of the supply frequency to such a drive motor is conveniently effected by means of a static frequency inverter, for example an inverter of the type supplied by Rieter Machine Works Ltd. under the name "Texinvert". One embodiment of such an inverter is described in U.S. Pat. No. 4,061,948, granted Dec. 6, 1977, but other inverter designs can also be used with the present invention. In a system using a static frequency inverter to supply an electric drive motor, the setting device 82 would set both the clock pulse generator 64 and a conventional and therefore not particularly shown oscillator which determines the supply frequency to the chuck drive motor. If the overall machine design is such that the chuck drive motor is mechanically capable of driving the chuck 22 at a rotational speed N substantially in excess of the maximum safe limit, then setting device 82 should be so arranged that it is impossible to set the machine 18 to operate at such high take-up speeds. Additional monitoring may also be provided to avoid errors, as will be described later.

The embodiment shown in FIG. 9 is arranged in the form of an computer designed to simulate the equation $$N = \frac{Vc}{\pi D} \text{ (see FIG. 2)}$$

wherein

N is the chuck rotational speed,
Vc is a constant take-up speed,
D is the package diameter, and
$\pi$ is the circle constant.

Once again, the tacho-generator 50 provides a pulse output with a pulse frequency representing the instantaneous rotational speed N of the chuck. This is fed as an input to a comparator 86. Also, the setting device 82 and the correspondingly variable clock pulse generator 64 are arranged to provide a pulse output signal with a pulse rate directly related to the set take-up speed. In this case, however, the pulse output from clock 64 is fed to a pulse rate divider 88 where it is divided by a constant factor K. The divided pulse output from device 88 is fed to a second divider 90 where the pulse rate is divided by a controllably adjustable factor dependent upon the instantaneous input from a dividing factor control 92. The output of dividing factor control 92 in turn is determined by the sensor 58 which responds to the package diameter D. The output of dividing factor control 92 is so adjusted by the sensor 58 that the dividing factor in divider 90 increases as linear function of package diameter D, and the output of divider 90 therefore has a pulse rate which reduces with increasing package diameter. This output is also fed to the comparator 86.

The detailed structure of dividing factor control 92 depends upon the structures of sensor 58 and divider 90 since control 92 effectively forms a matching link between sensor 58 and divider 90. If sensor 58 provides an analog output signal, dividing factor control 90 could for example be an analog to digital convertor.

The pulse rate of the output signal from tacho-generator 50 is directly representative of the rotational rate N of the chuck 22 (see FIG. 2). The pulse rate of the clock pulse generator 64 must be so chosen that the divided pulse rate at the output from divider 90 is correspondingly representative of the limit take-up speed Vl for a given set speed V set in device 82. Comparator 86 is arranged to produce an alarm signal on an output 94 when it detects that the pulse rate on its input from tacho-generator 50 is greater than the pulse rate on its input from divider 90. Since the pulse output from divider 90 is dependent upon both the set take-up speed and the package diameter D, this embodiment operates in accordance with FIG. 5.

FIG. 10 shows an embodiment which is essentially the same as FIG. 9 but which operates on analog instead of digital signals. The tacho-generator producing an output dependent on chuck rotational rate N is indicated by the reference numeral 51 and provides in this case a voltage signal which is fed to comparator 86. Comparator 86 is in this case designed to compare voltage signals, but since the operating principle is the same as that used in FIG. 9, the same reference numeral 86 has been used. Tacho-generator 51 may produce a voltage signal directly, or it may comprise a pulse generator (similar to tacho-generator 50) combined with a frequency/voltage convertor.

The voltage generator device by the reference numeral 96 produces a voltage output adjustably variable in dependence upon the set take-up speed and representing the appropriate limit speed Vl for the set take-up speed. Voltage generator device 96 may be arranged to produce a voltage directly in response to the setting of take-up speed, or it can comprise a clock pulse generator similar to clock pulse generator 64 in conjunction with a frequency to voltage convertor. The output of voltage generator device 96 is fed to a potential divider 98, indicated as a dotted line block 98, and comprising a fixed element 100 and a variable element the potential-dividing capacity of which is directly dependent upon the package diameter D so that this variable element represents the sensor 58 in the present embodiment. The output of the potential divider 98 is passed to buffer amplifier 102 and hence to the comparator 86. The principle of operation is identical to that of the embodiment of FIG. 9, the fixed dividing factor being built directly into the potential divider 98. Accordingly, it is not believed necessary to describe operation of this embodiment in further detail.

Figure 11:
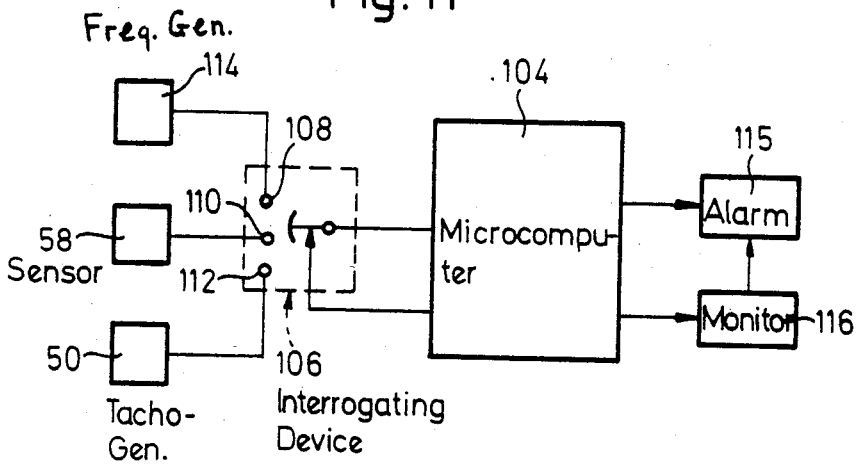
FIG. 11 shows a further embodiment using a microprocessor as part of the monitor circuit.
Figure 11:
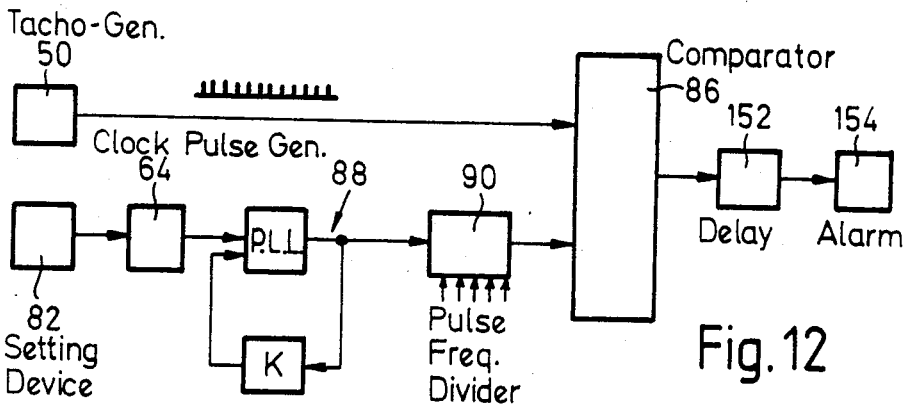

FIG. 11 illustrates an arrangement for enabling a micro-computer 104 to perform an overspeed monitoring function in accordance with the invention. Associated with the micro-computer 104 is an interrogating or sampling device 106 indicated within a dotted line block, the interrogating device 106 being operable under the control of the micro-computer 104 to sample inputs appearing on terminals 108, 110 and 112 respectively.

On terminal 108 there appears an input representative of the set take-up speed, this input being derived from the frequency generator device 114 which is adapted to provide an output with a frequency dependent upon the set speed. Frequency generator device 114 could, for example, be an oscillator controlling the supply frequency supplied by a static frequency inverter to the chuck drive motor 22, as already described above. On terminal 110 there appears a signal instantaneously representative of the package diameter D. This signal is therefore derived directly or indirectly from the sensor 58. The signal appearing on terminal 110 has a frequency varying as a linear function of the package diameter D.

On terminal 112 there appears a signal representative of the actual rotational rate N of the chuck 22, derived for example from the tacho-generator 50 already described above. The signal appearing on terminal 112 has a frequency varying as a linear function of the instantaneous chuck rotation rate N. Interrogator device 116 supplies to the micro-computer 104 samples representing the instantaneous frequencies appearing on terminals 108, 110 and 112 respectively. Using these samples together with a program based upon equations already described above with reference to the other embodiments, micro-computer 104 can continuously compare the instantaneous rotation rate N of the chuck 22 with an instantaneous limit value therefor. The limit value can be made directly dependent upon the package diameter and can be adjustable for each winding operation in dependence upon the take-up speed set for that winding operation and the tolerance permitted for wander of the actual take-up speed above the set take-up speed. This tolerance can be set as a fixed input in the data store of the micro-computer 104. It will be understood that the micro-computer 104 does not necessarily compute and compare speeds but can operate on functions indirectly representative of such speeds, for example frequencies or times.

Micro-computer 104 issues an output signal to an alarm-issuing device 115 when an overspeed is detected. An alarm is also issued when a so-called "watch-dog" or monitor device 116 detects a malfunction in the operation of the micro-computer itself.

The micro-computer 104 can also monitor the signal representing the set take-up speed. As indicated above, the setting device 82 itself should be arranged so that an unduly high set take-up speed cannot be entered by error. There remains, however, the possibility of a defect arising in the device itself or in the not particularly shown parts which respond thereto in order to supply information regarding the set speed to the control system for the chuck drive. Micro-computer 104 can therefore be arranged to cause production of an alarm signal when it detects that the signal representing the set take-up speed has risen above some predetermined level which can be programmed into the micro-computer 104 as fixed data therein. The other systems described above do not include a micro-computer, and it may be necessary in those other systems to provide a specific monitoring system responding to the signal representing the set take-up speed and issuing an alarm when this signal indicates an unduly high set speed. It is believed that such monitoring systems will be readily apparent to those skilled in the electronics art, and that therefore there is no necessity to provide detailed information regarding such systems in this specification.

Of all of these possibilities, the preferred embodiment is that shown in FIG. 9. Two more detailed arrangements suitable for putting this embodiment into effect will now be described with reference to FIG. 12 and FIG. 1. In relation to FIG. 1 it can be assumed that either the chuck 22 is arranged for movement relative to the headstock 20 or the roller 32 or 40 is so arranged, but not both. The movable element is mounted on a not particularly shown, suitable carrier and this movable carrier is linked to a potentiometer 118 (FIG. 12A and FIG. 12B) so that the potential on a tapping 120 of this potentiometer is dependent upon the position of the carrier relative to the headstock.

Figure 12:
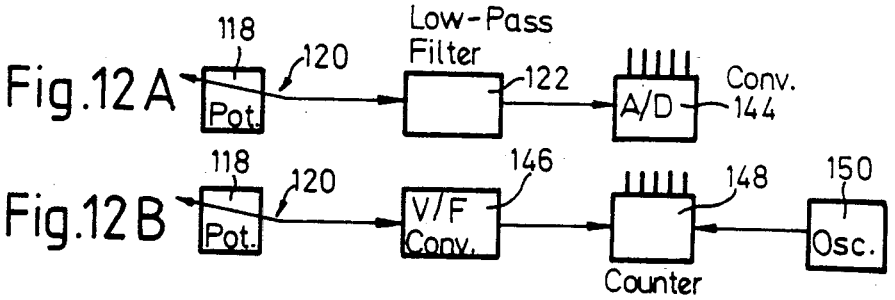
FIG. 12 shows a circuit diagram of a preferred embodiment.

In the variant represented in FIG. 12A, the variable potential output by the potentiometer 118 is fed to a low-pass filter 122 in which relatively high frequency disturbances are removed. The output of the filter is fed to an analog-to-digital convertor 144, the output of which is fed to the pulse frequency divider 90 which is shown in FIG. 12 and has already been described with reference to FIG. 9.

In the variant represented in FIG. 12B, the potential appearing at the output of potentiometer 118 is fed as an input to a voltage-to-frequency convertor 146 the output of which is fed to a counter 148. Counter 148 is enabled by an oscillator 150 providing rectangular pulses similar to those shown in FIG. 6B but of constant length. Counter 148 therefore measures pulse rate at the output of convertor 146 and provides the result as data input to the pulse frequency divider 90.

Some additional details of the preferred embodiments have also been shown in FIG. 12. Thus, fixed divider 88 comprises a phase locked loop circuit (details of which can be obtained from the book HALBLEITER-SCHALTUNGSTECHNIK already referred to above, especially Section 26.4.5 at page 714.

This circuit is adapted to multiply the output of generator 64 by a constant factor K. A delay device 152 is connected to the output of comparator 86 so that the system returns to normal if a detected error is corrected within a predetermined period after first detection thereof. If not, an output signal is passed by the delay device 152 to an alarm-producing device 154. Alarm device 154 is preferably arranged to de-energize the chuck drive motor.

In the description of the preferred embodiments, it has been assumed that the tachosignal is derived from a tacho-generator 50 provided specifically for this purpose. As indicated previously, this is not essential. For example, where the chuck is driven by an Ac motor energized by an inverter, as described above with reference to FIG. 8, the tachosignal could be derived directly or indirectly from the inverter output if the slip in the motor can be ignored.

While there are shown and described present preferred embodiments of the invention, it is to be distinctly understood that the invention is not limited thereto but may be otherwise variously embodied and practiced within the scope of the following claims. Accordingly,

What we claim is:

1. A method of detecting an overspeed in winding of thread by a chuck-driven winder, comprising the steps of:

producing a first signal which is representative of an instantaneous chuck rotation speed;

producing a second signal which is representative of an instantaneous limit rotational speed for the chuck and which is a function of package diameter;

comparing said first and said second signals; and producing a third signal indicating an overspeed condition if the instantaneous chuck rotation speed represented by the first signal exceeds the instantaneous limit rotational speed represented by the second signa1.

2. The method as defined in claim 1, further including the steps of:

controlling the chuck rotation speed by reference to an adjustable speed setting; and adapting said second signal to correspond with said adjustable speed setting.

3. The method as defined in claim 1, further including the step of:

controlling the actual chuck rotation speed by reference to a speed setting; and said second signal being independent of said speed setting.

4. The method as defined in claim 2, wherein:

said first signal is a time-varying signal;

a frequency of said first signal being a predetermined function of the actual chuck rotation speed;

said second signal being another time-varying signal;

a frequency of said second signal being a predetermined function of the speed setting and of the package diameter; and an overspeed signal being produced when said frequency of the first signal exceeds said frequency of the second signal.

5. A winding machine, comprising:

at least one chuck;

means for driving said at least one chuck into rotation about its own longitudinal axis;

means for producing a first signal representative of a rotational speed of the at least one chuck;

means for producing a second signal representative of a limit value for said rotational speed of the at least one chuck;

said means for producing said second signal being such that an output signal thereof varies as a function of the diameter of a package of thread building on the at least one chuck; and means for comparing said first and second signals.

6. The winding machine as defined in claim 5, wherein:

said means for producing said first signal representative of said rotational speed of said at least one chuck comprises a tacho-signal generator; and part of said tacho-signal generator being coupled to the at least one chuck for rotation therewith.

7. The winding machine as defined in claim 5, further including:

a support frame;

a part which moves relative to said support frame in dependence of a build-up of said package; and means responsive to movements of said part relative to the support frame for causing said second signal to vary as a function of package diameter.

8. The winding machine as defined in claim 5, further comprising:

control means for controlling said means for driving said chuck;

setting means for setting a predetermined take-up speed for use as a reference value by said control means; and said means for producing said second signal being adapted to vary said second signal in dependence upon said predetermined take-up speed.

* * * * *